US007614990B2

(12) United States Patent
Baek

(10) Patent No.: US 7,614,990 B2
(45) Date of Patent: Nov. 10, 2009

(54) TWIST AND HOPPING EXERCISE MACHINE

(76) Inventor: Kyoung-Gil Baek, 1104 Dong 306 Ho Jinangolmaul, 911 Jinan-dong, Hwaseong (KR) 445-770

( * ) Notice: Subject to any disclaimer, the term of this patent is extended or adjusted under 35 U.S.C. 154(b) by 0 days.

(21) Appl. No.: 11/996,577

(22) PCT Filed: Jul. 24, 2006

(86) PCT No.: PCT/KR2006/002902

§ 371 (c)(1),
(2), (4) Date: Jan. 23, 2008

(87) PCT Pub. No.: WO2007/015603

PCT Pub. Date: Feb. 8, 2007

(65) Prior Publication Data

US 2008/0280741 A1 Nov. 13, 2008

(30) Foreign Application Priority Data

Aug. 4, 2005 (KR) ..... 10-2005-0071187

(51) Int. Cl.
*A63B 22/14* (2006.01)

(52) U.S. Cl. ..... 482/146; 482/77; 482/79

(58) Field of Classification Search ..... 482/34, 482/146–147, 77, 148, 79–80; *A63B 22/14*
See application file for complete search history.

(56) References Cited

U.S. PATENT DOCUMENTS 4,953,858 A * 9/1990 Zelli ..... 482/147
6,692,419 B2 * 2/2004 Chen ..... 482/146
6,921,353 B2 * 7/2005 Chuang ..... 482/52
7,008,359 B2 3/2006 Fan et al.
7,175,577 B2 * 2/2007 Greenspan et al. ..... 482/146
7,374,522 B2 * 5/2008 Arnold ..... 482/146
2004/0198573 A1 * 10/2004 Brydson et al. ..... 482/146
2006/0084554 A1 * 4/2006 Bement ..... 482/79

FOREIGN PATENT DOCUMENTS

JP 13-224726 8/2001
KR 20-368296 11/2004

* cited by examiner

*Primary Examiner*—Lori Amerson
(74) *Attorney, Agent, or Firm*—IPLA P.A.; James E. Bame

(57) ABSTRACT

Disclosed is a twist exercise machine for waist and leg exercise. The twist exercise machine composed of base, rotation panel and rotation axis, once the user goes up on the machine and steps on it, the rotation panel receives the force of the weight and the opposing force of spring or compressed air, moving the panel upwards or downwards, and coupled with the vertical movement of the rotation panel, it allow at least 1 unit of 4 step left-right rotation cycle methods as the following: once the rotation panel moves down it rotates left (downwards-left rotation step), when it moves up it rotates right (upwards-right rotation step), when it moves down it rotates right (downwards-right rotation step), and when it moves up it rotates left (upwards-left rotation step), forming a complete cycle of 4 steps.

7 Claims, 6 Drawing Sheets

TWIST AND HOPPING EXERCISE MACHINE

TECHNICAL FIELD

The present invention is a twist exercise machine, where the user goes up on the rotation panel and steps on it (runs on it), the rotation panel automatically rotates left and right, allowing forceful (active) waist twist exercise, and it results in an aerobic exercise effect equal to that of walking up and down as well as asserting forceful waist rotation on the waist, allowing stretching exercise effect.

BACKGROUND ART

As well known in the art, a twist exercise machines allow twisting of the foot or the waist, but all of them were manual exercise machines where rotation panel would rotate when the user would grab hold of a fixture and intentionally twist the waist or the feet, and the exercise method would be limited to stretching of the foot or the waist.

DISCLOSURE OF INVENTION

Technical Problem

As well known in the art, a twist exercise machine consists of the user stepping on the rotation panel and twisting the waist to rotate the rotation panel, resulting in merely twisting stretching exercise from the lower-body waist rotation, which is passive and only having simple and limited exercise effect, also if the user were to be lazy and not twist the waist, it would have no effect whatsoever.

Technical Solution

To solve the above problems with the present invention, when the user of the machine goes up on the rotation panel and steps (runs) on it, the rotation panel coupled with the vertical movement rotates left and right causing forceful waist twist exercise, resulting in aerobic exercise effect as if the user is stepping up and down, and with the automatic forceful left-right rotation of the rotation panel, the waist is forced to rotate left and right resulting in waist exercise and stretching effect as well as resulting in strong waist rotation force from the rotation panel, allowing stretching exercise effects. Also to maintain balance during rotation, the user has to physically move the upper-body and the arms, resulting in fun and active exercise.

ADVANTAGEOUS EFFECTS

Accordingly, once the user steps on the rotation panel, the rotation panel automatically repeats the 4 step cycle of downwards-left rotation, upwards-right rotation, downwards-right rotation and upwards-left rotation due to the coupled 4 step left-right rotation method, which will allow aerobic exercise similar to light running through up-down movement, and with the rotation panel rotation forcefully, also allows stretching exercise effect through waist twisting.

That is, the present invention twist and hopping exercise machine give new exercise method and facility and effect. When the user of the machine goes up on the rotation panel and steps on it, the rotation panel receives the force of the weight and the opposing force of spring, moving the panel upwards or downwards and coupled with the 4 step left-right rotation method, it moves automatically downwards, and with repetitions of downwards-left rotation step, upwards-right rotation step, downwards-right rotation step, and upwards-left rotation step 4 step 1 cycle exercise, it forces left-right rotation force to the waist regardless of the will of the user, allowing aerobic exercise similar to a running machine while allowing stretching effects with the rotation of the waist. Also, to maintain balance during the left-right rotation of the rotation panel, the user must move the upper body and arms physically, resulting in active and fun exercise similar to aerobics or dance. As the twist exercise machine allows stand-up exercise, the user may watch a TV or such while exercising to reduce boredom, and as it is a light exercise it does not have much time restrictions. It also occupies a smaller space than a running machine while allowing leg exercise similar to light walking, resulting in convenient exercising in a small, restricted space.

BEST MODE FOR CARRYING OUT THE INVENTION

To achieve the above tasks, the present invention consists of a base, rotation panel and a rotation axis, and with a twist exercise machine allowing waist and leg exercise on the rotation panel, once the user goes up on the machine and steps on it, the rotation panel receives the force of the weight and the opposing force of spring or compressed air, moving the panel upwards or downwards, and coupled with the vertical movement of the rotation panel, it allows at least 1 unit of 4 step left-right rotation cycle methods as the following: once the rotation panel moves down it rotates left (downwards-left rotation step), when it moves up it rotates right (upwards-right rotation step), when it moves down it rotates right (downwards-right rotation step), and when it moves up it rotates left (upwards-left rotation step), forming a complete cycle of 4 steps.

The above 4 step left-right rotation methods has the following composition characteristics: coupling rod fixed to the rotation panel; fixed rod fixed to the base; corresponding multi-axis joints installed opposite of the above coupling rod and fixed rod; connecting rod joining the above two multi-axis joints.

The multi-axis joint is can comprise by a flexible-material, for an example, a rubber.

The detailed description of the twist exercise machine of the present invention with the included drawings is as follows.

Figure 1:
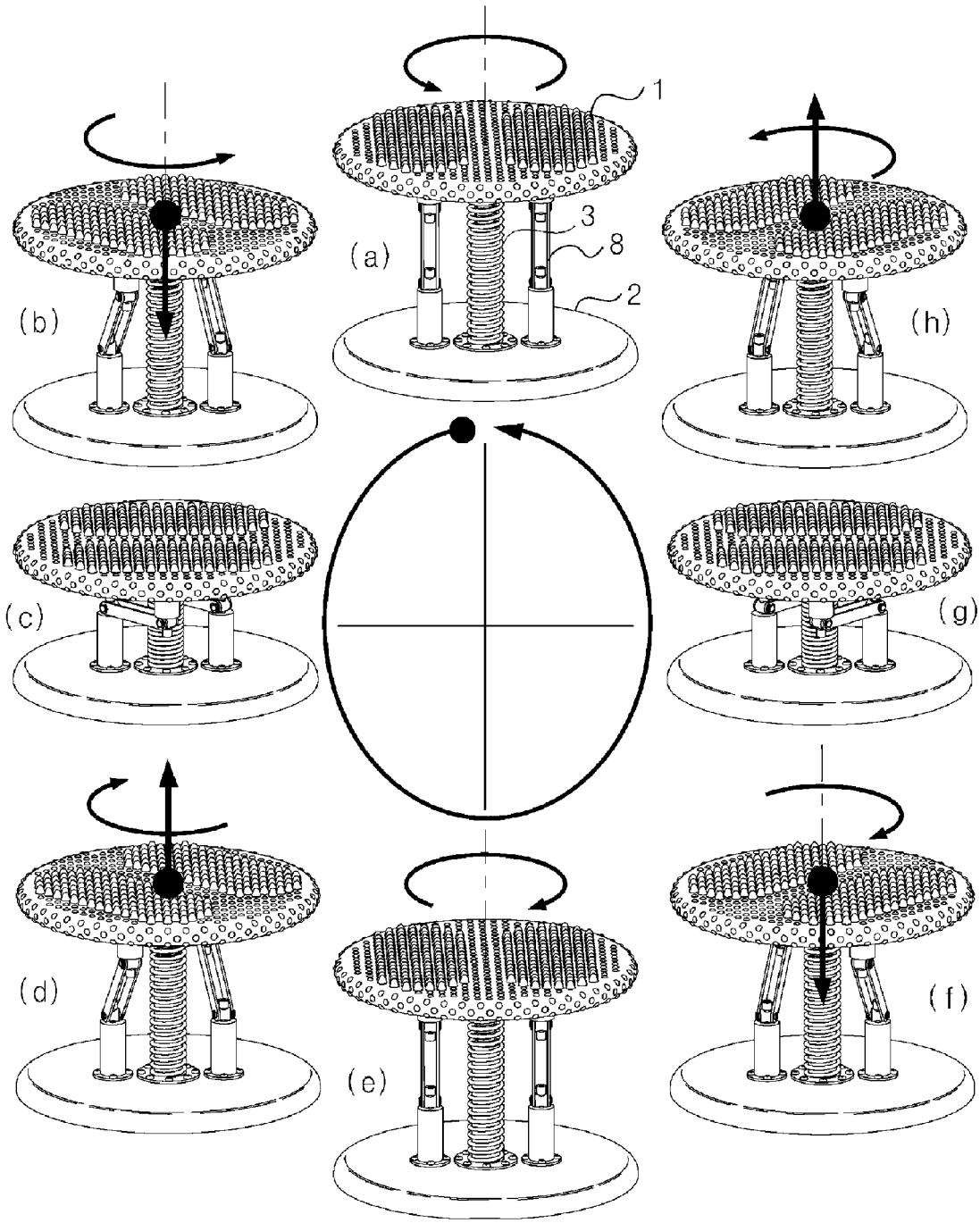
FIG. 1: 4 step description of the twist exercise machine provided by the present invention
Figure 2:
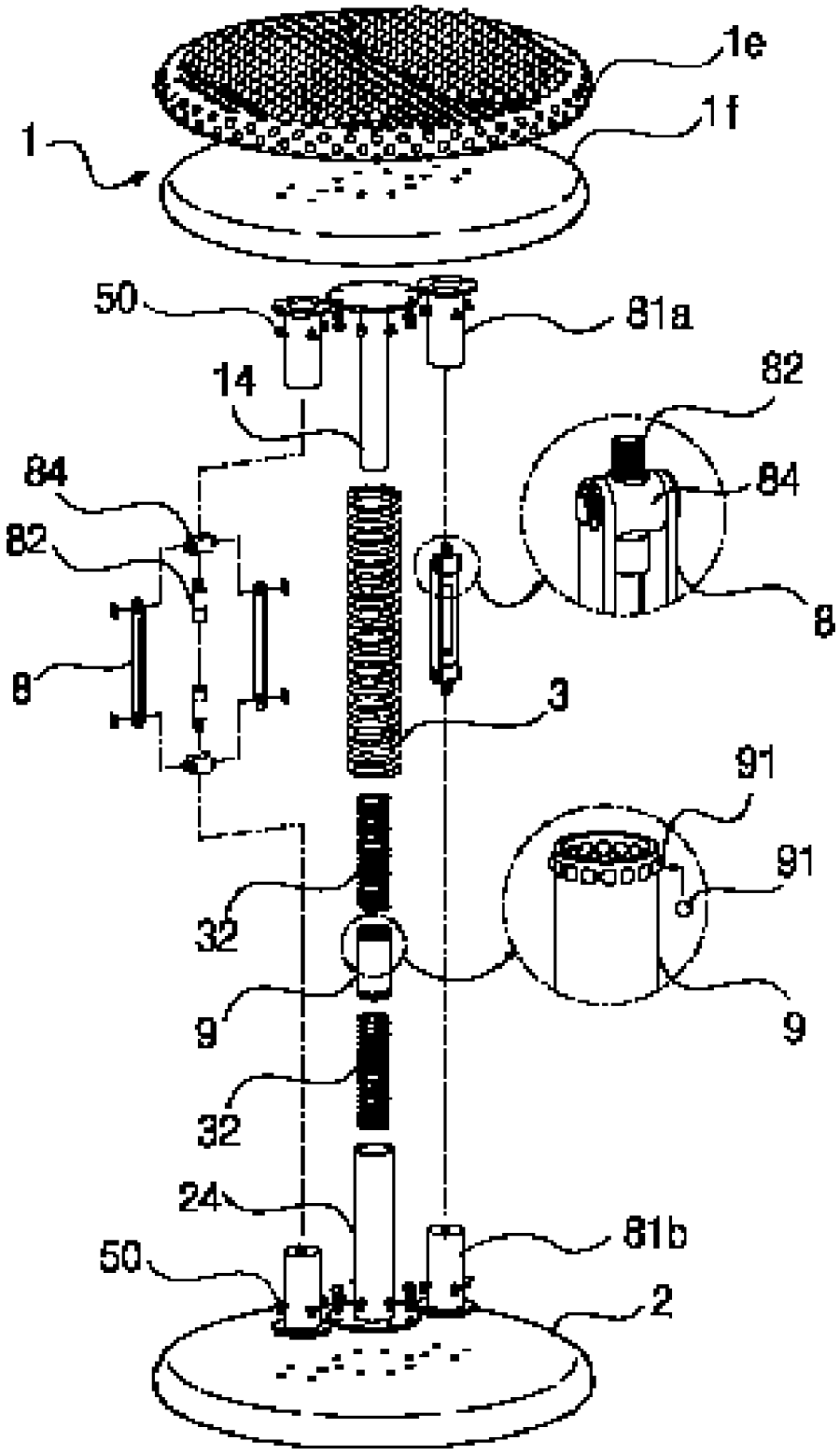
FIG. 2: Exploded oblique view of the connecting rod-type twist exercise machine provided by the present invention
Figure 3:
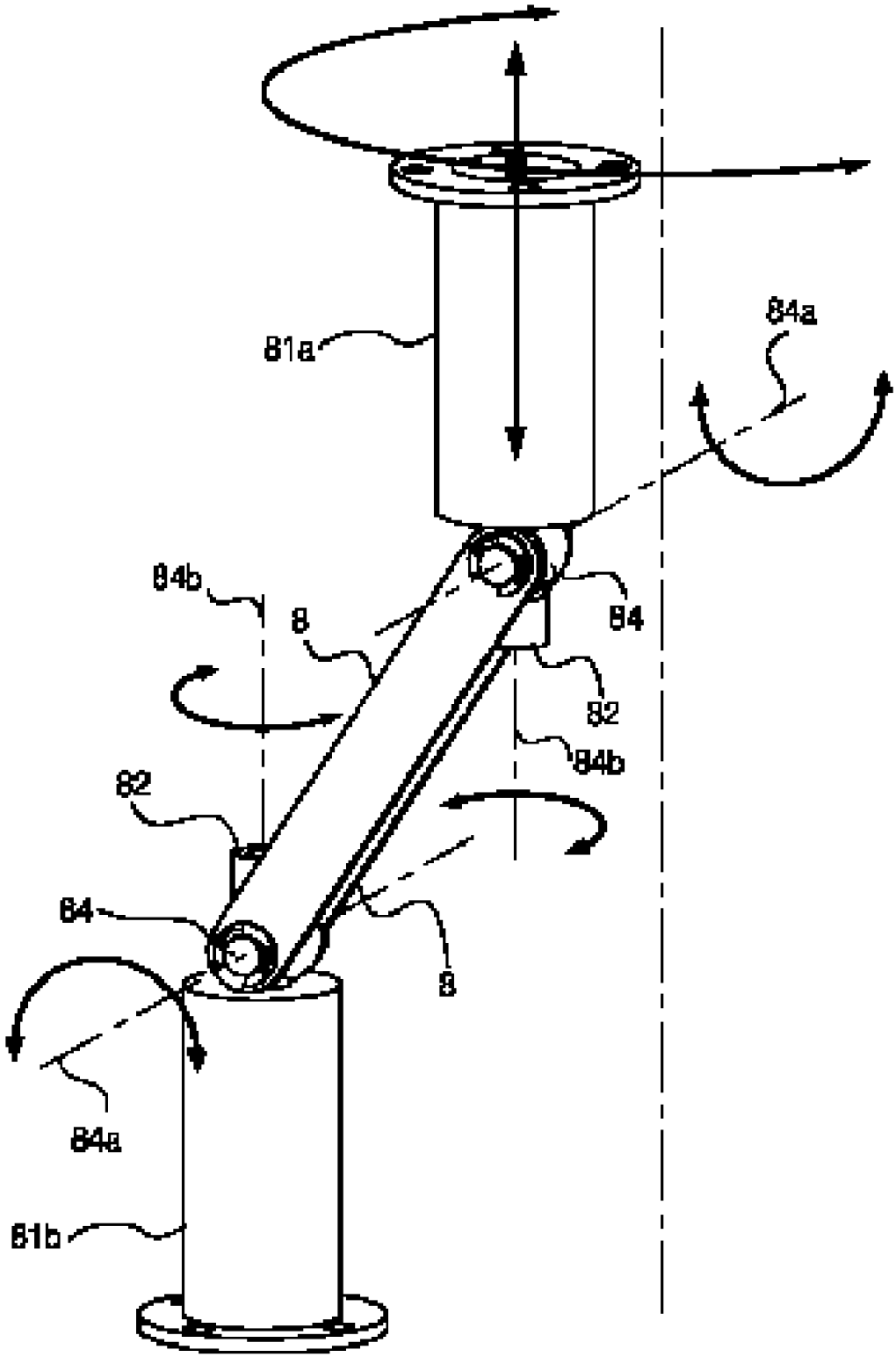
FIG. 3: Link area oblique view of the connecting rod-type twist exercise machine provided by the present invention
Figure 4:
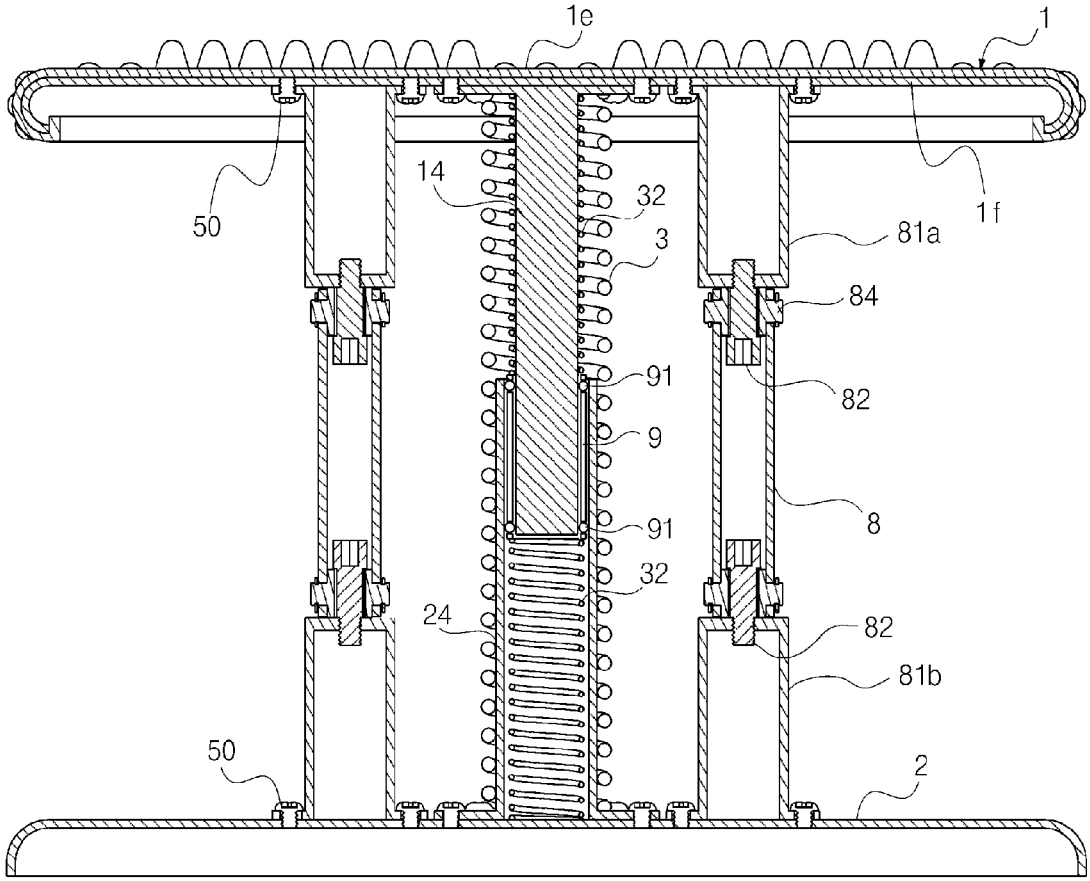
FIG. 4: Vertical cross section view of the connecting rod-type twist exercise machine provided by the present invention
Figure 5:
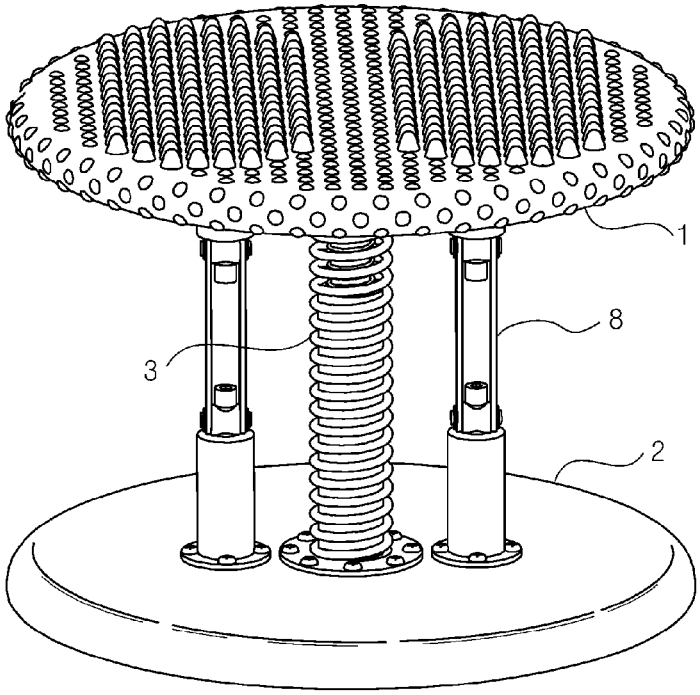
FIG. 5: Oblique view of the of the connecting rod-type twist exercise machine provided by the present invention with 0 degree rotation
Figure 6:
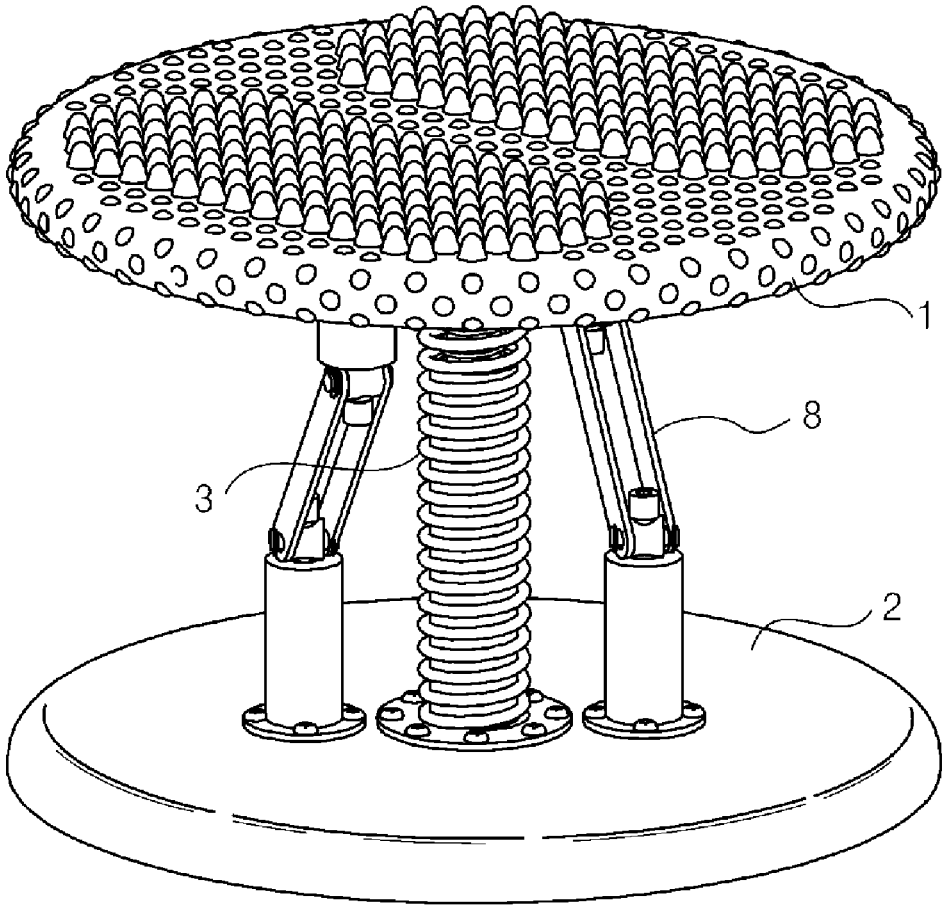
FIG. 6: Oblique view of the of the connecting rod-type twist exercise machine provided by the present invention with −45 degree rotation
Figure 7:
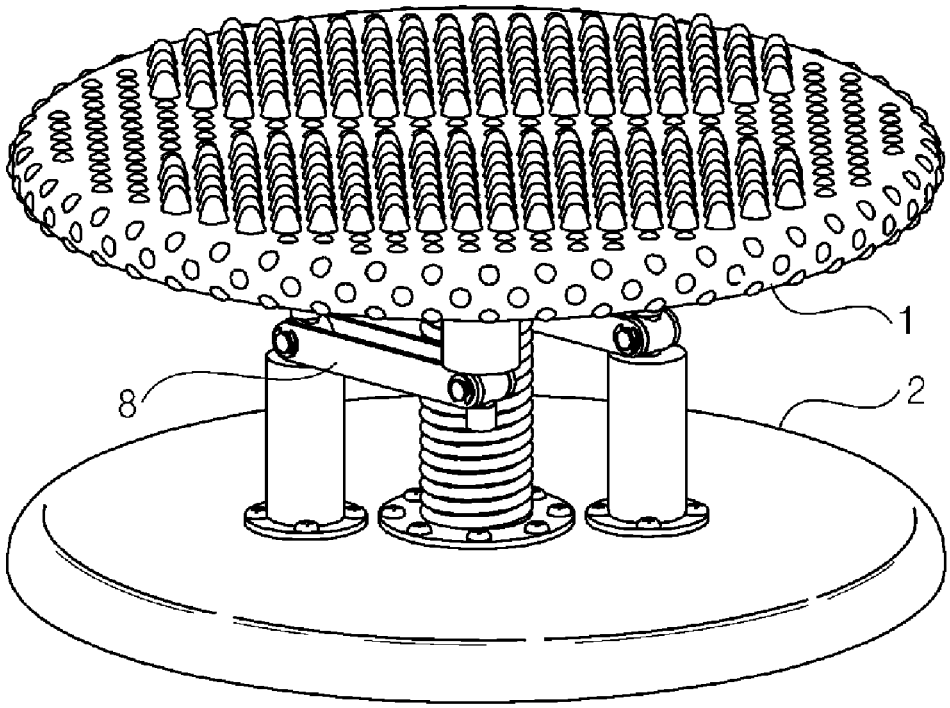
FIG. 7: Oblique view of the of the connecting rod-type twist exercise machine provided by the present invention with −90 degree rotation
Figure 8:
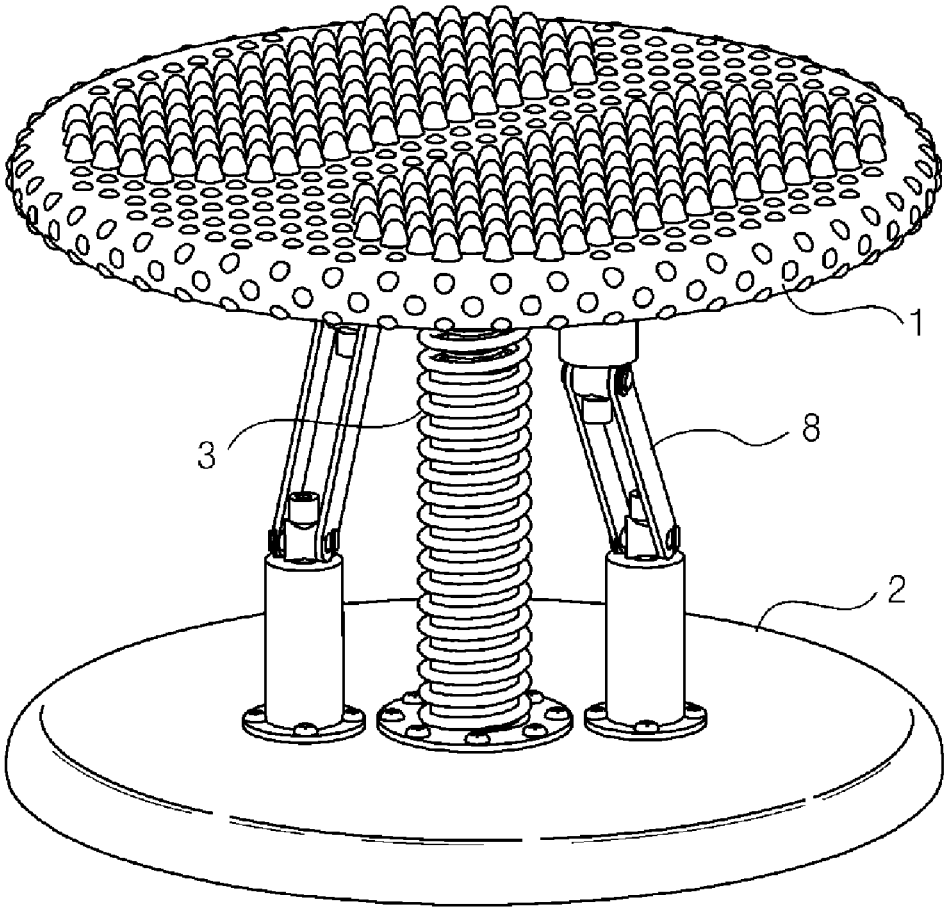
FIG. 8: Oblique view of the of the connecting rod-type twist exercise machine provided by the present invention with +45 degree rotation
Figure 9:
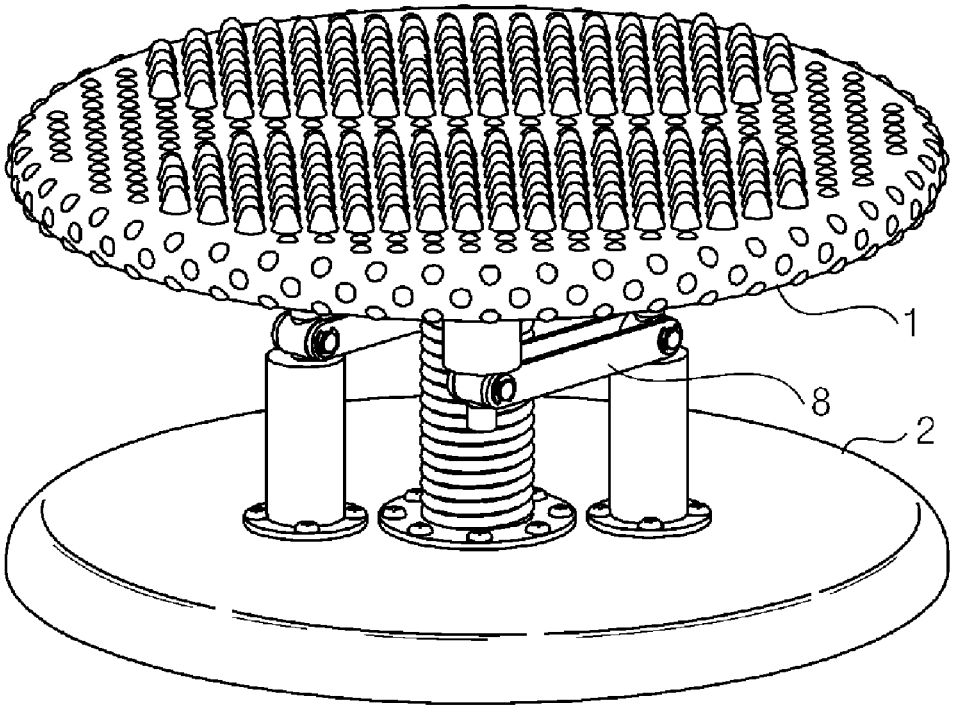
FIG. 9: Oblique view of the of the connecting rod-type twist exercise machine provided by the present invention with +90 degree rotation

FIG. 1 displays the single cycle from the point among the 4 steps of the twist exercise machine from the uppermost point (a) of the rotation panel, rotating leftwards, and coming back to the original position after 4 steps. FIG. 2 disassembles the connecting rod-type twist exercise machine from the present invention for easy to understand display of each part. FIG. 3 magnifies the 4 step left-right rotation method part of the connecting rod-type twist exercise machine from the present invention; FIG. 4 shows the vertical cross section view of the connecting rod-type twist exercise machine from the present invention; FIG. 5 shows the easy to recognize oblique view of the rotation panel of the connecting rod-type twist exercise machine from the present invention when in 0 degree rotation; FIG. 6 shows −45 degree rotation oblique view; FIG. 7 shows −90 degree rotation oblique view; FIG. 8 shows +45 degree rotation oblique view; FIG. 9 shows +90 degree rotation oblique view, respectively.

Detailed descriptions of the figures are as follows.

FIG. 1 shows the step-by-step view of the 4 step operation of the twist exercise machine from the present invention. Sections (a) to (c) are downwards-left rotation, it may occur when the user steps on the rotation panel (1) in the beginning. As the rotation panel (1) moves downwards the connecting rod (8) rotates left, the balance between the stepping force with the weight of the user and the spring (3) becomes the bottom dead center, stopping the downwards movement and left-rotation movement for the moment, while the force of the spring compressed by maximum strength prepares (c) to move the rotation from bottom to the top. Continuing, the user jumps (the situation where the user jumps slightly to reduce the weight force or is in the air) upwards with the help of the maximum compressed spring, where the rotation panel moves upwards as shown in sections (c) to (e), while the coupled connecting rod (8) simultaneously rotates right, creating upwards-right rotation step. This is followed by (e), where the rotation panel reaches the top dead center while its right rotation velocity reaches maximum velocity, the movement inertial force allows the rotation panel to keep on rotating after passing the top dead center, at which point the user who jumped according to the timing lands on the rotation panel, the weight force presses the spring counter force weakened by expansion and allows the rotation panel to keep moving downwards, and with the help of the coupled connecting rod (8) the rotation panel keeps on rotating right while moving downwards, creating downwards-right rotation step in sections (e) to (g). Once downwards-right rotation step is complete, opposite from the step taken in (c), right rotation step is complete as it reaches the bottom dead center and becomes as shown in (g) and the body of the user moves in a direction opposite to the previous bottom dead center (c), and with the help of the maximum compressed spring (3) force, when the user jumps upwards, the rotation panel (1) moves upwards while rotating left form sections (g) to (a), creating upwards-left rotation step as the top dead center reaches the origin, completing 4 step, 1 cycle. With the user continuously stepping on the rotation panel (or jumping), the above 4 step cycle [downwards-left rotation {(a)~(c)}, upwards-right rotation {(c)~(e)}, downwards-right rotation {(e)~(g)}, upwards-left rotation {(g)~(a)}] is repeated, allowing up-down jump with simultaneous twist exercise.

FIG. 2 disassembles the connecting rod-type twist exercise machine from the present invention for easy recognition of each part, the rotation panel (1) is composed of rotation pressure cover (Ie) that includes protrusions for pressuring the foot and covered by a rotation panel steel panel (If) for maintaining machine structure and stress to form a single body. In the lower rotation center, the rotation panel axis (14) is fixed by a bolt (50), above which is situated 2 ball retainer spring (32) and between the 2 is situated the ball retainer (9) which maintains the positions of the multiple bearing balls (91), that are inserted to the axis cylinder (24) in the base (2). On the outer walls of the axis cylinder (24) is inserted the spring (3) supporting the rotation panel with the primary force. Also on the lower layer of the rotation panel (1), a coupling rod (81*a*) is fixed around the rotation axis with the bolt (50), on the upper layer of the base (2) to facing the above, a fixed rod (81*b*) is fixed with the bolt (50), and on the side of the aforementioned coupling rod (81*a*) and fixed rod (81*b*) is a multi-axis joint cross axis (84) composing multi-axis joint fixed by multi-axis joint cross fixed bolt rod (82). To the above multi-axis joint cross axis (84) is connected a connecting rod (8) to form 4 step left-right rotation method part.

FIG. 3 displays only the 4 step left-right rotation method part, showing the movements of the connecting rod and the multi-axis joint. Each multi-axis joint has two perpendicular multi-axis joint rotation center (84*a*), (84*b*), therefore the connecting rod (8) connected to the above multi-axis joint ca move in all directions as with the universal joint. Therefore as the connecting rod (8) moves the rotation panel side multi-axis joint due to the movements of the up-downwards or rotation movement of the rotation panel, the connecting rod (8) connected to the above is fixed by the base (2) of the other side's multi-axis joints nodal point, resulting in the multi-axis joint of the coupling rod (81*a*) moving in a 3-dimensional movement along the constant cylindrical outer walls, following which the rotation panel simultaneously moves in up-downwards and left-right rotation. The multi-axis joint is also possible with a ball-type multi-axis joint rather than an universal joint-type.

FIG. 4 is the vertical cross section view of the connecting rod-type twist exercise machine from the present invention, displaying the assembly and bonding of the parts shown in disassembly diagram in FIG. 2.

FIGS. 5 to 9 shows the oblique view of the connecting rod-type twist exercise machine from the present invention's rotation panel in 5 different locations in 45 degree angles and displays the variations to the multi-axis joint according to the location of the rotation panel in each situation.

The effect of the twist exercise machine from the present invention as seen above is as follows.

When the user of the machine goes up on the rotation panel (1), the rotation panel (1) receives the force of the weight of the user moving the panel downwards. At this point due to the connecting rod, the rotation panel rotates left, and the downwards movement and the left rotation continues until the force of the user stepping on the rotation panel and the spring (3) reaches a balance point at the bottom dead center (downwards-left rotation step). Once the bottom dead center is reached, stopping the downwards movement and left-rotation movement for the moment, the force of the spring compressed by maximum strength moves the rotation panel from bottom to top. Using this force, the user jumps (the situation where the user jumps slightly to reduce the weight force or is in the air) upwards as the rotation panel moves upwards as shown in sections while the connecting rod rotates the rotation panel right until the top dead center (upwards-right rotation step). Once top dead center is reached, the rotation panel's right rotation velocity reaches maximum velocity, while the movement inertial force allows the rotation panel to keep on rotating after passing the top dead center, at which point the user who jumped according to the timing lands on the rotation panel, the weight force presses the spring counter force weakened by expansion and allows the rotation panel to keep moving downwards, and with the help of the coupling rod the rotation panel keeps on rotating right while moving downwards, until the bottom dead center created by the balance of the mass and the spring compression force (downwards-right rotation). Once bottom dead center is reached, the body of the user moves in a direction opposite to the previous bottom dead center, and with the help of the maximum compressed spring force, when the user jumps upwards, the rotation panel moves upwards while rotating left once again reaching the top dead center (upwards-left rotation step). Once the origin top dead center and the movement direction is reached, 1 cycle is completed, and with the user continuously stepping on the rotation panel (or jumping), the above 4 step cycle [downwards-left rotation {(a)~(c)}, upwards-right rotation {(c)~(e)}, downwards-right rotation {(e)~(g)}, upwards-left rotation {(g)~(a)}] is repeated, allowing up-down jump with simultaneous, automatic twist exercise regardless of the will of the user.

That is, once the user steps on the rotation panel, the rotation panel automatically repeats the 4 step cycle of downwards-left rotation, upwards-right rotation, downwards-right rotation and upwards-left rotation due to the coupled 4 step left-right rotation method, which will allow aerobic exercise similar to light running through up-down movement, and with the rotation panel rotation forcefully, also allows stretching exercise effect through waist twisting.

MODE FOR THE INVENTION

Expression in Best Mode (or no relation)

INDUSTRIAL APPLICABILITY

The effects of the twist exercise machine from the present invention are as follows. When the user of the machine goes up on the rotation panel and steps on it, the rotation panel receives the force of the weight and the opposing force of spring, moving the panel upwards or downwards and coupled with the 4 step left-right rotation method, it moves automatically downwards, and with repetitions of downwards-left rotation step, upwards-right rotation step, downwards-right rotation step, and upwards-left rotation step 4 step 1 cycle exercise, it forces left-right rotation force to the waist regardless of the will of the user, allowing aerobic exercise similar to a running machine while allowing stretching effects with the rotation of the waist. Also, to maintain balance during the left-right rotation of the rotation panel, the user must move the upper body and arms physically, resulting in active and fun exercise similar to aerobics or dance. As the twist exercise machine allows stand-up exercise, the user may watch a TV or such while exercising to reduce boredom, and as it is a light exercise it does not have much time restrictions. It also occupies a smaller space than a running machine while allowing leg exercise similar to light walking, resulting in convenient exercising in a small, restricted space.

SEQUENCE LISTING

Empty (no relation)

The invention claimed is:

1. A twist and hopping exercise machine for waist and leg exercises, the exercise machine comprising:

a base;

a rotation panel disposed oppositely and above the base with a predetermined distance, and sized and configured for a user to step on;

said panel movable in a left and right direction, upwards and downwards direction;

a spring centrally interposed between the base and the rotation panel and elastically supporting from each other;

and a pair of connecting rods having one end pivotally connected to the base for a multi-axis joint bouncing motion and an opposite end pivotally connected to the rotation panel for a multi-axis joint bouncing motion, said rods each being disposed on both sides of the spring.

2. The exercise machine according to claim 1, further comprising: an axis cylinder fixed on the center of the base; and a rotation panel axis fixed on the rotation panel, wherein the rotation panel axis is inserted in the axis cylinder, and the axis cylinder and the rotation panel axis are inserted in the spring.

3. The exercise machine according to claim 2, wherein the axis cylinder includes a ball retainer spring therein to elastically support the rotation panel axis.

4. The exercise machine according to claim 3, wherein the ball retainer spring is two which are longitudinally provided in the axis cylinder, and a ball retainer is further provided between the two to maintain the position of a plurality of bearing balls on the ball retainer spring.

5. The exercise machine according to claim 1, wherein the multi-axis joint motion of the pair of connecting rods by multi-axis joint cross axes which are disposed between said one end and the base and between said other end of said base and the rotation panel.

6. The exercise machine according to claim 5, wherein the multi-axis joint cross axes is fastened to the base and the rotation panel by bolts.

7. The exercise machine according to claim 5, wherein the multi-axis joint cross axes includes two multi-axis joint rotation centers perpendicular from each other, and thereby the connecting rods connected to the multi-axis joint cross axes moves in multiple directions.

* * * * *